US011713218B2

(12) United States Patent
Chen et al.

(10) Patent No.: US 11,713,218 B2
(45) Date of Patent: Aug. 1, 2023

(54) AUTOMATIC CONTAINER LANDING DEVICE BASED ON EXPERT SYSTEM AND CONTROL METHOD THEREFOR

(71) Applicant: Shanghai Master Matrix Information Technology Co., Ltd, Shanghai (CN)

(72) Inventors: Huan Chen, Shanghai (CN); En Shao, Shanghai (CN); Xianwu Li, Shanghai (CN)

(73) Assignee: Shanghai Master Matrix Information Technology

( * ) Notice: Subject to any disclaimer, the term of this patent is extended or adjusted under 35 U.S.C. 154(b) by 0 days.

(21) Appl. No.: 17/922,202

(22) PCT Filed: Apr. 26, 2021

(86) PCT No.: PCT/CN2021/089938
§ 371 (c)(1),
(2) Date: Oct. 28, 2022

(87) PCT Pub. No.: WO2021/227858
PCT Pub. Date: Nov. 18, 2021

(65) Prior Publication Data

US 2023/0131592 A1 Apr. 27, 2023

(30) Foreign Application Priority Data

May 11, 2020 (CN) ..... 202010389831.8

(51) Int. Cl.
*B66C 13/00* (2006.01)
*B66C 13/08* (2006.01)
(Continued)

(52) U.S. Cl.
CPC ..... *B66C 13/085* (2013.01); *B66C 1/101* (2013.01); *B66C 13/48* (2013.01)

(58) Field of Classification Search
CPC ..... B66C 13/063; B66C 13/085; B66C 13/23; B66C 13/44; B66C 13/46; B66C 13/48; B66C 5/04; B66C 1/101
See application file for complete search history.

(56) References Cited

U.S. PATENT DOCUMENTS

| | | | |
|---|---|---|---|
| 2002/0024598 | A1 | 2/2002 | Kunimitsu et al. |
| 2005/0103738 | A1 | 5/2005 | Recktenwald et al. |
| 2016/0122161 | A1 | 5/2016 | Mannari et al. |

FOREIGN PATENT DOCUMENTS

| | | | |
|---|---|---|---|
| CN | 1338421 | A | 3/2002 |
| CN | 203699702 | U | 7/2014 |

(Continued)

OTHER PUBLICATIONS

Chinese Notification of the First Office Action for Chinese Application No. 202010389831.8, dated Jun. 28, 2020, 11 pages.

(Continued)

*Primary Examiner* — Emmanuel M Marcelo
(74) *Attorney, Agent, or Firm* — RatnerPrestia

(57) ABSTRACT

The present invention provides an automatic container landing device based on an expert system and a control method therefor. The device comprises at least four groups of cameras and at least six groups of single-point laser devices, wherein the at least four groups of cameras and four groups of single-point laser devices in the at least six groups of single-point laser devices are arranged at four spreader corners of a spreader fixing support; two groups of single-point laser devices in the at least six groups of single-point laser devices are respectively arranged on the outer sides of two short edges of the spreader fixing support; the front end of the spreader fixing support is lower than the rear end of the spreader fixing support; and the first group of cameras and the second group of cameras in the at least four groups of cameras, as well as the first group of laser devices and the (Continued)

second group of laser devices, and the third group of cameras and the fourth group of cameras, as well as the third group of laser devices and the fourth group of laser devices, are arranged at the front end and the rear end of the spreader fixing support respectively. According to the automatic container landing device based on the expert system, manual container landing experience is integrated into various sensors, a spreader is controlled by means of sensing signals, low-point and high-point container landing of a container is conducted, automatic dynamic container landing of the container is achieved, high-precision measurement is achieved with the cooperation of the cameras and the single-point laser devices, and therefore, the precision and efficiency of the container landing operation are improved.

10 Claims, 4 Drawing Sheets

(51) Int. Cl.
*B66C 13/48* (2006.01)
*B66C 1/10* (2006.01)

(56) References Cited

FOREIGN PATENT DOCUMENTS

| | | | | | |
|---|---|---|---|---|---|
| CN | 105492365 | A | | 4/2016 | |
| CN | 205709438 | U | | 11/2016 | |
| CN | 110142805 | A | | 8/2019 | |
| CN | 110171779 | A | | 8/2019 | |
| CN | 110869306 | A | * | 3/2020 | ..... B66C 1/101 |
| CN | 111302226 | A | | 6/2020 | |
| DE | 102004041938 | A1 | | 3/2006 | |
| JP | 2018203397 | A | * | 12/2018 | ..... B66C 13/46 |
| KR | 100624008 | B1 | * | 9/2006 | ..... B66C 13/085 |
| KR | 101058594 | B1 | * | 8/2011 | ..... B66C 19/002 |
| KR | 20150105287 | A | * | 9/2015 | ..... B66C 13/18 |
| WO | WO-2019104251 | A1 | * | 5/2019 | ..... B66C 13/46 |

OTHER PUBLICATIONS

Chinese Notification of Grant of Invention Patent for Chinese Application No. 202010389831.8, dated Jul. 21, 2020, 2 pages.
International Search Report and Written Opinion for International Application No. PCT/CN2021/089938, dated Jun. 28, 2021, 7 pages.

* cited by examiner

AUTOMATIC CONTAINER LANDING DEVICE BASED ON EXPERT SYSTEM AND CONTROL METHOD THEREFOR

CROSS-REFERENCE TO RELATED APPLICATIONS

This is a National Phase Application of International Application No. PCT/CN2021/089938 filed Apr. 26, 2021, which claims priority to Chinese Application No. 202010389831.8, filed May 11, 2020. The disclosure of each of these applications is incorporated herein by reference in its entirety for all purposes.

TECHNICAL FIELD

The present invention relates to the field of container loading and unloading, and more particularly to an automatic container landing device based on an expert system and a control method therefor.

BACKGROUND ART

With the continuous growth of China's import and export trade, the requirements for throughput and efficiency of port container loading business are also increasing, among which the rubber tyred container gantry crane is a common container loading and unloading device on the terminal. In the case of manual container landing, a key step affecting the efficiency is to align and place the container at the last stage, especially when the container shakes due to movement or strong wind. This process is also a technical difficulty in the fully automatic crane system. Some existing schemes have some limitations. For example, camera-based schemes are easily affected by weather, it is inaccurate, large delay, long waiting time, and affect efficiency. In addition, shaking can be reduced by changing the mechanical structure of the spreader, but shaking cannot be completely removed, and the cost of improvement is also high. Therefore, the existing technology needs to be improved.

SUMMARY OF THE INVENTION

The technical problem to be solved by the present invention is to provide an automatic container landing device based on an expert system and a control method therefor, the high-precision dynamic automatic container loading is realized by several groups of cameras and several single-point laser devices are arranged on the spreader fixing support.

The technical solution adopted by the present invention to solve the above technical problem is to provide an automatic container landing device based on an expert system, comprising: at least four groups of cameras and at least six groups of single-point laser devices, the at least four groups of cameras, as well as the first group, the second group, the third group and the fourth group of single-point laser devices in the at least six groups of single-point laser devices are arranged at four spreader corners of a spreader fixing support of the container, the fifth group and the sixth group of single-point laser devices in the at least six groups of single-point laser devices are respectively arranged on the outer sides of two short edges of the spreader fixing support;

the front end of the spreader fixing support is lower than the rear end of the spreader fixing support, and the first group of cameras and the second group of cameras in the at least four groups of cameras, as well as the first group of single-point laser devices and the second group of single-point laser devices are arranged at the front end of the spreader fixing support; the third group of cameras and the fourth group of cameras in the at least four groups of cameras, as well as the third group of single-point laser devices and the fourth group of single-point laser devices are arranged at the rear end of the spreader fixing support; the fifth group of single-point laser devices are arranged on the outer sides of the short edges of the front end of the spreader fixing support, the fifth group of single-point laser devices are low-point single-point laser devices; the sixth group of single-point laser devices are arranged on the outer sides of the short edges of the rear end of the spreader fixing support, the sixth group of single-point laser devices are high-point single-point laser devices, the groups of cameras are cooperated with the corresponding single point laser devices;

if the first group and the second group of single-point laser devices, the low-point and the high-point laser devices have no trigger signal, and there is low-point container landing signal, then low-point container landing is completed and enter high-point container landing; the low-point container landing signal is a corresponding mechanical limit signal generated by the operation container when the bottom of the rear end of the spreader fixing support is in complete contact with the top of a bottom layer of containers;

if the third group and the fourth group of single-point laser devices have no trigger signal, and there is high-point container landing signal or rope loosening signal, high-point container landing is completed, complete the container landing of the operation container; the high-point container landing signal is a corresponding mechanical limit signal generated by the operation container when the bottom of the rear end of the spreader fixing support is in complete contact with the top of the bottom layer of containers.

Optionally, further comprising a first inertial measurement unit, a second inertial measurement unit, a third inertial measurement unit and a fourth inertial measurement unit arranged at four spreader corners of the spreader fixing support, the first, the second, the third and the fourth inertial measurement units are used to measure and calculate the angle, speed and relative displacement of the spreader.

Optionally, the first, the second, the third, the fourth, the fifth and the sixth groups of single-point laser devices are used to measure the height difference between a laser emission point and a laser reflection point to confirm the landing error of the operation container;

the first, the second, the third and the fourth groups of cameras obtain the distance between a light spot of the corresponding single-point laser device and the side of the bottom container through images, or the first, the second, the third and the fourth groups of cameras obtain the distance between the side of the operation container and the side of the bottom container through the images to confirm the landing error of the operation container.

Optionally, the distance between light spots of the first, the second, the third, the fourth, the fifth and the sixth groups of single-point laser devices and the side of the container is measured through the first, the second, the third, the fourth groups of cameras, the position and angle of the first, the second, the third, the fourth, the fifth and the sixth groups of single-point laser devices is adjusted, so as to calibrate the position and angle of the first, the second, the third, the fourth, the fifth and the sixth groups of single-point laser devices, so that the distance between light spots of the first, the second, the third, the fourth, the fifth and the sixth groups of single-point laser devices and the side of the operation container is a preset installation offset distance of the laser devices.

Another technical solution adopted by the present invention to solve the above technical problem is to provide a control method of automatic container landing device based on an expert system, comprising the following steps:

S11: install at least four groups of cameras and at least six groups of single-point laser devices;

S12: control a spreader to drive an operation container to move to the position above a bottom layer of containers;

S13: control the spreader to drive the operation container to move downwards to trigger dynamic container landing and enter a dynamic container landing mode;

S14: enter low-point container landing, and enter high-point container landing after low-point container landing is completed;

S15: enter high-point container landing to complete container landing of the operation container.

Optionally, control the spreader to drive the operation container to move downwards to trigger dynamic container landing in step S13 comprising when the distance between the bottom of the operation container and the top of the bottom layer of containers is less than or equal to a preset first threshold, trigger the dynamic container landing.

Optionally, the step S14 specifically comprising the following steps:

S141: if the first group and the second group of single-point laser devices, as well as the low-point and the high-point single-point laser devices have no trigger signal, the horizontal moving speed calculated by the first and second inertial measurement units is less than a preset first speed threshold value, and there is no low-point container landing signal, control the spreader to descend;

S142: if at least one of the first group and the second group of single-point laser devices, as well as the low-point and the high-point single-point laser devices have a trigger signal, and there is a low-point container landing signal, and it is confirmed that the low-point container landing error is greater than the installation offset distance of the laser devices through the first group and the second group of cameras, then control the spreader to lift a first distance, and conduct low-point container landing again;

S143: if at least one of the first group and the second group of single-point laser devices, as well as the low-point and the high-point single-point laser devices have a trigger signal, and there is no low-point container landing signal, then stop the spreader to descend and obtain the trigger duration of the trigger signal, if the first group of single-point laser devices or the second groups of single-point laser devices are continuously triggered longer than a second threshold, then control the spreader to move a second distance along the width direction of the operation container to the first groups of single-point laser devices or the second groups of single-point laser devices with the trigger signal; if the low-point single-point laser devices or the high-point single-point laser devices are continuously triggered for more than the second threshold, control the spreader to move a third distance along the length direction of the operation container to the low-point single-point laser devices or the high-point single-point laser devices with the trigger signal;

S144: if the first group and the second group of single-point laser devices, as well as the low-point and the high-point single-point laser devices have no trigger signal and there is a low-point container landing signal, low-point container landing is completed and enter high point container landing.

Optionally, the second threshold is T/2, T is the swing period of the spreader, and the swing period T is determined by the formula $T=\alpha*2\pi\sqrt{l/g}$, where l is the rope length of the spreader, $\alpha$ is the damping coefficient.

Optionally, the step S15 specifically comprising the following steps:

S151: if the third group and the fourth group of single-point laser devices have no trigger signal, the horizontal moving speed calculated by the third and fourth inertial measurement units is less than a preset second speed threshold, and there is no high-point container landing signal, control the spreader to descend until obtain the high-point container landing signal;

S152: if the third group and the fourth group of single-point laser devices have a trigger signal, and there is no high-point container landing signal or rope loosening signal, stop the spreader to descend, get the alignment deviation through the third group and the fourth group of cameras, and control the spreader to move the corresponding distance along the width direction of the operation container to the third group and the fourth group of single-point laser devices with a trigger signal;

S153: if the third group and the fourth group of single-point laser devices have trigger signals, and there is a high-point container landing signal or rope loosening signal, and it is confirmed that the high point container landing error is greater than a preset container landing accuracy Dt through the third group and the fourth group of cameras, then control the spreader to lift for a fourth distance, and conduct high-point container landing again;

S154: if the third group and the fourth group of single-point laser devices have no trigger signal, and there is high-point container landing signal or rope loosening signal, high-point container landing is completed, complete the container landing of the operation container.

Optionally, in the step S11 further comprising that the at least four groups of cameras and the at least six groups of single-point laser devices are calibrated, the distance is measured between the light spots of the first group, the second group, the third group, the fourth group, the fifth group and the sixth group of single-point laser devices, as well as the low-point and the high-point single-point laser devices and the side of the container through the first group, the second group, the third group, the fourth group of cameras, and the position and angle of the first group, the second group, the third group, the fourth group, the fifth group and the sixth group of single-point laser devices, as well as the low-point and the high-point single-point laser devices to calibrate the position and angle of the first group, the second group, the third group, the fourth group, the fifth group and the sixth group of single-point laser devices, as well as the low-point and the high-point single-point laser devices, so that the distance between the spots of the first group, the second group, the third group, the fourth group, the fifth group and the sixth group of single-point devices, as well as the low-point and the high-point single-point laser devices and the side of the operation container is a preset installation offset distance of the laser devices.

Compared to the prior art, the technical solutions of embodiments of the present invention have the following advantageous effects:

The automatic container landing device based on an expert system and a control method therefor provided by the present invention, several groups of cameras and several groups of single-point laser devices are arranged on a spreader fixing support, control a spreader by means of sensing signals, first conduct low-point container landing of a container, and then conduct high-point container landing, automatic dynamic container landing of the container is achieved.

Further, several groups of cameras and corresponding single-point laser devices are cooperated together for high-precision measurement to ensure the accuracy range of the container landing, the accuracy range is usually 3-5 cm, so that the accuracy and efficiency of automatic container loading of the container is improved.

Wherein:

| | |
|---|---|
| 1. | first group of cameras; |
| 2. | second group of cameras; |
| 3. | third group of cameras; |
| 4. | fourth group of cameras; |
| 5. | low-point single-point laser device; |
| 6. | high-point single-point laser device; |
| 7. | first inertial measurement unit; |
| 10. | spreader fixing support; |
| 11. | operation container; |
| 12. | bottom container. |

DETAILED DESCRIPTION OF THE INVENTION

The present invention will be further described below in combination with the accompanying drawings and embodiments.

An expert system refers to the way of applying the container loading method obtained from the experience of manual experts to the automatic container loading of the mechanical structure of the tire crane. During manual container landing, according to the driver's habit of container landing, a certain angle of inclination will be maintained during the installation of the spreader, so that the front end of the spreader fixing support is slightly lower than the rear end, so as to facilitate manual operation. When lifting operation containers, the two corners of the corresponding front end of the spreader fixing support of the container are low-points, and the two corners of the corresponding of the rear end of the spreader fixing support are high-points. First conduct low-point container landing, then conduct high-point container landing.

Figure 1:
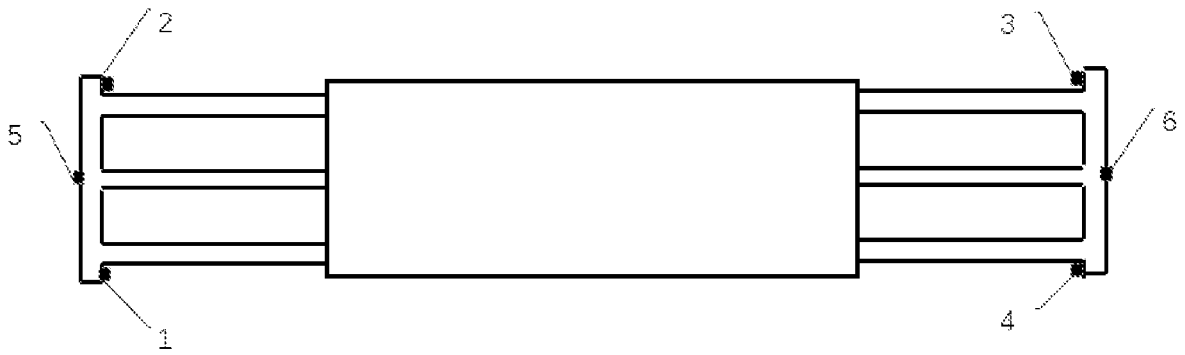
FIG. 1 is an installation diagram of an automatic container landing device based on an expert system according to an embodiment of the present invention.
Figure 2:
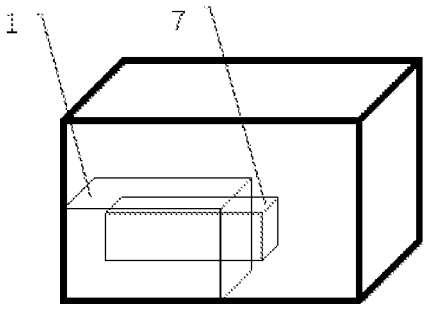
FIG. 2 is an installation diagram of the first group of cameras and the first inertial measurement unit according to an embodiment of the present invention.

FIG. 1 is an installation diagram of an automatic container landing device based on an expert system according to an embodiment of the present invention, FIG. 2 is an installation diagram of the first group of cameras and the first inertial measurement unit according to an embodiment of the present invention.

Please refer to FIG. 1 and FIG. 2, the automatic container landing device based on an expert system according to an embodiment of the present invention, comprising at least four groups of cameras and at least six groups of single-point laser devices, the at least four groups of cameras, as well as the first group, the second group, the third group and the fourth group of single-point laser devices in the at least six groups of single-point laser devices are arranged at four spreader corners of a spreader fixing support 10 of the container, the fifth group and the sixth group of single-point laser devices in the at least six groups of single-point laser devices are respectively arranged on the outer sides of two short edges of the spreader fixing support 10;

the front end of the spreader fixing support 10 is lower than the rear end of the spreader fixing support 10, and the first group of cameras 1 and the second group of cameras 2 in the at least four groups of cameras, as well as the first group of single-point laser devices and the second group of single-point laser devices are arranged at the front end of the spreader fixing support 10; the third group of cameras 3 and the fourth group of cameras 4 in the at least four groups of cameras, as well as the third group of single-point laser devices and the fourth group of single-point laser devices are arranged at the rear end of the spreader fixing support 10; the fifth group of single-point laser devices are arranged on the outer sides of the short edges of the front end of the spreader fixing support 10, the fifth group of single-point laser devices are low-point single-point laser devices 5; the sixth group of single-point laser devices are arranged on the outer sides of the short edges of the rear end of the spreader fixing support 10, the sixth group of single-point laser devices are high-point single-point laser devices 6.

In a particular implementation, the first group of cameras 1, the second group of cameras 2, the third group of cameras 3 and the fourth group of cameras 4 are arranged at four spreader corners of the spreader fixing support, preferably on the outside of the short sides of the spreader, or on the inside of the short sides of the spreader. The first group of single-point laser devices, the second group of single-point laser devices, the third group of single-point laser devices and the fourth group of single-point laser devices (not shown in the figure) are arranged at four spreader corners of the spreader fixing support, preferably on the inside of the short sides of the spreader, or on the outside the short sides of the spreader. Low-point single-point laser devices 5 and high-point single-point laser devices 6 are arranged on the outside of the short sides of the spreader, preferably on the center of the outside of the short sides of the spreader, or on one end of the outside of the short sides of the spreader, as long as the detection requirements can be met. In a particular implementation, the first group of cameras 1, the second group of cameras 2, the third group of cameras 3 and the fourth group of cameras 4 are preferably arranged symmetrically along the short and long sides of the spreader. The first group of cameras 1 and the first single-point laser devices, as well as the second group of cameras 2 and the second single-point laser devices are preferably arranged symmetrically along the short and long sides of the spreader. The third group of cameras 3 and the third single-point laser devices, as well as the fourth group of cameras 4 and the fourth single-point laser devices are preferably arranged symmetrically. The first group of cameras 1 and the first group of single-point laser devices, as well as the second group of cameras 2 and the second group of single-point laser devices, as well as the third group of cameras 3 and the third group of single-point laser devices, as well as the fourth group of cameras 1 and the fourth group of single-point laser devices are cooperated separately, cameras and laser devices can be arranged on the same sides or the different sides of the short sides of the spreader. Those skilled in the art should understand the first group of cameras 1 and the first group single-point laser devices, as well as the second group of cameras 2 and the second group single-point laser devices can be arranged symmetrically or not symmetrically, the third group of cameras 3 and the third group single-point laser devices, as well as the fourth group of cameras 4 and the fourth group single-point laser devices can be arranged symmetrically or not symmetrically, which will not be repeated here.

In a particular implementation, further comprising a first inertial measurement unit 7, a second inertial measurement unit, a third inertial measurement unit and a fourth inertial measurement unit arranged at four spreader corners of the spreader fixing support, the first, the second, the third and the fourth inertial measurement units are used to measure and calculate the angle, speed and relative displacement of the spreader. The labels of the second, third and fourth inertial measurement units are not identified in the attached drawings. As shown in FIG. 2, the first group of cameras 1 and the first inertial measurement unit 7 are arranged in the same sensor box, the first laser devices can be arranged in the same sensor box or outside the same sensor box. Correspondingly, the second group of cameras 2 and the second inertial measurement unit, as well as the third group of cameras 3 and the third inertial measurement unit, as well as the fourth group of cameras 4 and the fourth inertial measurement unit can be arranged in the same sensor box or outside the same sensor box.

The first, the second, the third, the fourth, the fifth and the sixth groups of single-point laser devices are used to measure the height difference between a laser emission point and a laser reflection point to confirm the landing error of the operation container.

The first, the second, the third and the fourth groups of cameras obtain the distance between a light spot of the corresponding single-point laser device and the side of the bottom container 12 through images, or the first, the second, the third and the fourth groups of cameras obtain the distance between the side of the operation container 11 and the side of the bottom container 12 through the images to confirm the landing error of the operation container. In the day when the light is strong, it is difficult for the cameras to capture the spots of the single-point laser devices due to the influence of the light, and it is easier to distinguish the side edges of the container. Therefore, the distance between the side of the operation container 11 and obtain the side of the bottom container 12 to confirm the container error. In the dark night, it is easier for the cameras to capture the spots of the single-point laser devices, and it is difficult to distinguish the side edge of the container. Therefore, obtain the distance between the spots of the single-point laser devices and the side of the bottom container 12 to confirm the container error. the distance between light spots of the single-point laser devices and the side of the operation container 11 is measured through the cameras, the position and angle of the single-point laser devices is adjusted to calibrate the position and angle of the single-point laser devices, so that the distance between light spots of the single-point laser devices and the side of the operation container 11 is a preset installation offset distance of the laser devices.

In a particular implementation, the distance between light spots of the first, the second, the third, the fourth, the fifth and the sixth groups of single-point laser devices and the side of the container is measured through the first, the second, the third, the fourth groups of cameras, the position and angle of the first, the second, the third, the fourth, the fifth and the sixth groups of single-point laser devices is adjusted, so as to calibrate the position and angle of the first, the second, the third, the fourth, the fifth and the sixth groups of single-point laser devices, so that the distance between light spots of the first, the second, the third, the fourth, the fifth and the sixth groups of single-point laser devices and the side of the operation container is a preset installation offset distance of the laser devices.

Figure 3:
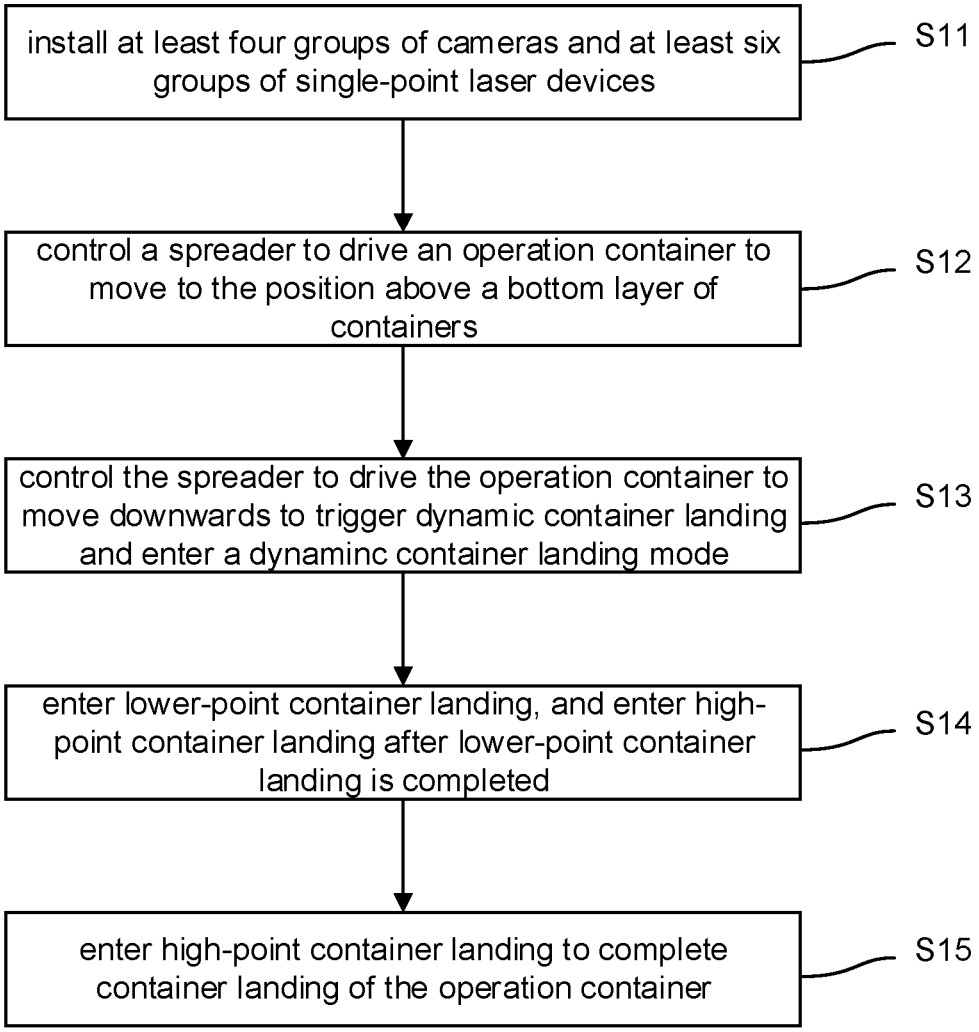
FIG. 3 is a flow chart of a control method of automatic container landing device based on an expert system according to an embodiment of the present invention.

Please refer to FIG. 3, a control method of automatic container landing device based on an expert system according to an embodiment of the present invention, comprising the following steps:

S11: install at least four groups of cameras and at least six groups of single-point laser devices;

S12: control a spreader to drive an operation container to move to the position above a bottom layer of containers;

S13: control the spreader to drive the operation container to move downwards to trigger dynamic container landing and enter a dynamic container landing mode;

S14: enter low-point container landing, and enter high-point container landing after low-point container landing is completed;

S15: enter high-point container landing to complete container landing of the operation container.

control the spreader to drive the operation container to move downwards to trigger dynamic container landing in step S13 comprising when the distance between the bottom of the operation container and the top of the bottom layer of containers is less than or equal to a preset first threshold, trigger the dynamic container landing.

Figure 4:
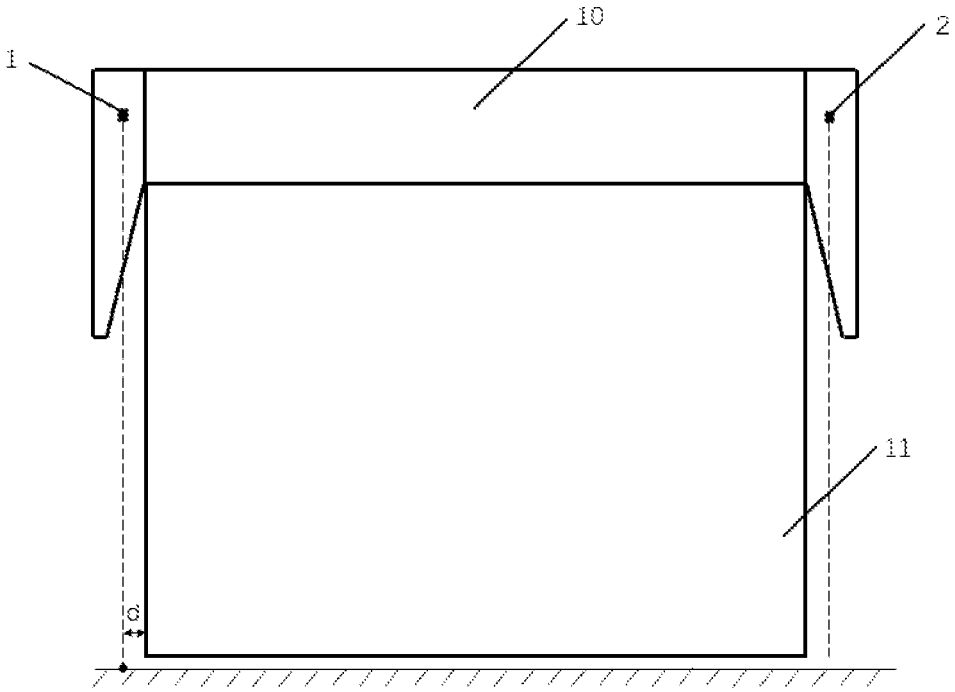
FIG. 4 is a calibration diagram of the single-point laser device according to an embodiment of the present invention.
Figure 5:
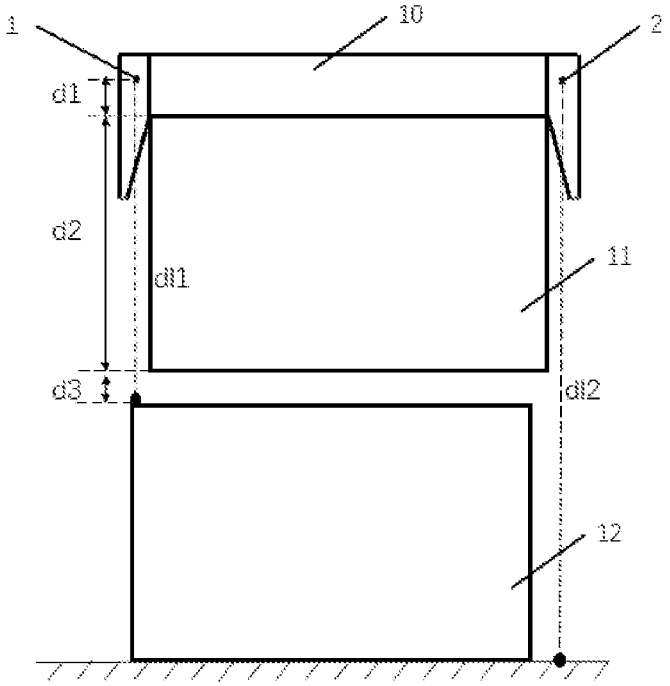
FIG. 5 is a front view of low-point container landing according to the present invention.
Figure 6:
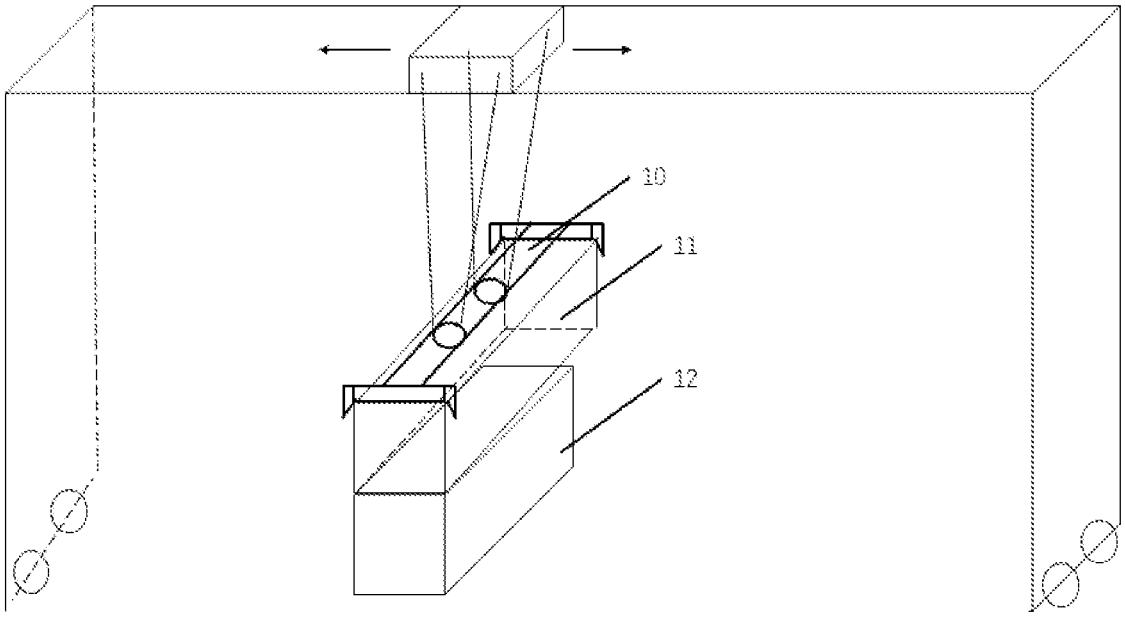
FIG. 6 is a diagram of high-point container landing according to the present invention.

Please refer to FIG. 2, FIG. 4 and FIG. 5, taking the first group of cameras 1 and the first group of single-point laser devices (not shown in the figure) as an example, when the first group of single-point laser devices and the first group of cameras 1 are being calibrated, the operation container 11 is held by the spreader, the operation container 11 suspended from the ground and kept still, the distance d between the spots of the first group of the single-point laser devices on the ground and the side of the bottom container 12, the position and angle of the first group single-point laser devices are adjusted slightly, so that the distance d is equal to the preset installation offset distance D of the laser devices, generally, the range of the installation offset distance D of the laser devices is 2-5 cm. The distance between light spots of the corresponding single-point laser device on the ground and the side of the operation container 11 is measured by images of the first group of cameras 1.

In a particular implementation, control the spreader to drive the operation container to move downwards to trigger dynamic container landing in step S13 comprising when the distance between the bottom of the operation container and the top of the bottom layer of containers is less than or equal to a preset first threshold, trigger the dynamic container landing, the first threshold is usually 2-3 cm.

Optionally, the step S14 specifically comprising the following steps:

S141: if the first group and the second group of single-point laser devices, as well as the low-point and the high-point single-point laser devices have no trigger signal, the horizontal moving speed calculated by the first and second inertial measurement units is less than a preset first speed threshold value, and there is no low-point container landing signal, control the spreader to descend, the low-point container landing signal is a mechanical limit signal generated when the bottom of the operation container corresponding to the front end of the spreader fixing support is in complete contact with the top of the bottom layer of containers;

S142: if at least one of the first group and the second group of single-point laser devices, as well as the low-point and the high-point single-point laser devices have a trigger signal, and there is a low-point container landing signal, and it is confirmed that the low-point container landing error is greater than the installation offset distance of the laser devices through the first group and the second group of cameras, then control the spreader to lift a first distance, and conduct low-point container landing again;

S143: if at least one of the first group and the second group of single-point laser devices, as well as the low-point and the high-point single-point laser devices have a trigger signal, and there is no low-point container landing signal, then the spreader is stopped to descend and obtain the trigger duration of the trigger signal, if the first group of single-point laser devices or the second groups of single-point laser devices are continuously triggered longer than a second threshold, then control the spreader to move a second distance along the width direction of the operation container to the first groups of single-point laser devices or the second groups of single-point laser devices with the trigger signal; if the low-point single-point laser devices or the high-point single-point laser devices are continuously triggered for more than the second threshold, control the spreader to move a third distance along the length direction of the operation container to the low-point single-point laser devices or the high-point single-point laser devices with the trigger signal;

S144: if the first group and the second group of single-point laser devices, as well as the low-point and the high-point single-point laser devices have no trigger signal and there is a low-point container landing signal, low-point container landing is completed and enter high point container landing.

Optionally, the first speed threshold can be set to 0.1 m/s, those skilled in the art can understand that the first speed threshold can be set according to an empirical value.

Optionally, the second threshold is T/2, T is the swing period of the spreader, and the swing period T is determined by the formula $T=\alpha*2\pi\sqrt{l/g}$, where l is the rope length of the spreader, $\alpha$ is the damping coefficient.

In a particular implementation, the second distance is usually 2-5 cm, and the third distance is usually 2-5 cm. The value of dynamic ranging of the single-point laser devices Lx (x=1 . . . 6) is set as dix, the ranging value of the trigger threshold of the single-point laser devices is set as DL, and DL=d1+d2+d3, wherein d1 is the vertical distance between the installation position of laser devices and the top of operation container 11, d2 is the height of operation container 11, and d3 is the dynamic landing threshold D3; When the cameras Cam x (x=1 . . . 4) detects that the alignment deviation of the operation container 11 is greater than the installation offset distance D of the laser equipment, and the spots of the single-point laser devices hits the top of the bottom layer of containers 12, then the dlx is less than DL, and the corresponding single-point laser devices generate a trigger signal, otherwise, the dlx is greater than DL, and the corresponding single-point laser devices have no trigger signal.

In a particular implementation, taking the operation container 11 and the bottom container 12 in FIG. 5 as an example, the dynamic ranging value of the single-point laser devices L1 is dl1, the dynamic ranging value of the single-point laser devices L2 is dl2, and the trigger threshold of the single-point laser devices ranging is DL, DL=d1+d2+d3, wherein d1 is the vertical distance between the installation position of the laser devices and the top of the operation container 11, d2 is the height of the operation container 11, and d3 is the dynamic landing threshold D3. When the cameras detect that the alignment deviation of the operation container 11 is greater than the installation offset distance D of the laser devices, and the spots of the single-point laser devices hit the top of the bottom layer of containers 12, then dl1 is less than DL, and the corresponding single-point laser devices generate a trigger signal, otherwise, dl1 is greater than DL, and the corresponding single-point laser devices have no trigger signal.

Optionally, the step S15 specifically comprising the following steps:

S151: if the third group and the fourth group of single-point laser devices have no trigger signal, the horizontal moving speed calculated by the third and fourth inertial measurement units is less than a preset second speed threshold, and there is no high-point container landing signal, control the spreader to descend until obtain the high-point container landing signal, the high-point container landing signal is a mechanical limit signal generated when the bottom of the operation container corresponding to the rear end of the spreader fixing support is in complete contact with the top of the bottom layer of containers;

S152: if the third group and the fourth group of single-point laser devices have a trigger signal, and there is no high-point container landing signal or rope loosening signal, the spreader is stopped to descend, get the alignment deviation through the third group and the fourth group of cameras, and control the spreader to move the corresponding distance along the width direction of the operation container to the third group and the fourth group of single-point laser devices with a trigger signal;

S153: if the third group and the fourth group of single-point laser devices have trigger signals, and there is a high-point container landing signal or rope loosening signal, and it is confirmed that the high point container landing error is greater than a preset container landing accuracy Dt through the third group and the fourth group of cameras, then control the spreader to lift for a fourth distance, and conduct high-point container landing again;

S154: if the third group and the fourth group of single-point laser devices have no trigger signal, and there is high-point container landing signal or rope loosening signal, high-point container landing is completed, complete the container landing of the operation container.

In a particular implementation, the fourth distance is usually 5-10 cm. Optionally, the second speed threshold can be set to 0.1 m/s. Those skilled in the art should understand that the second speed threshold can be set according to the empirical value.

Optionally, in the step S11 further comprising that the at least four groups of cameras and the at least six groups of single-point laser devices are calibrated, the distance is measured between the light spots of the first group, the second group, the third group, the fourth group, the fifth group and the sixth group of single-point laser devices, as well as the low-point and the high-point single-point laser devices and the side of the container through the first group, the second group, the third group, the fourth group of cameras, and the position and angle of the first group, the second group, the third group, the fourth group, the fifth group and the sixth group of single-point laser devices, as well as the low-point and the high-point single-point laser devices to calibrate the position and angle of the first group, the second group, the third group, the fourth group, the fifth group and the sixth group of single-point laser devices, as well as the low-point and the high-point single-point laser devices, so that the distance between the spots of the first group, the second group, the third group, the fourth group, the fifth group and the sixth group of single-point devices, as well as the low-point and the high-point single-point laser devices and the side of the operation container is a preset installation offset distance of the laser devices.

In summary, the automatic container landing device based on an expert system and a control method therefor provided by the present invention, several groups of cameras and several groups of single-point laser devices are arranged on a spreader fixing support, control a spreader by means of sensing signals, first conduct low-point container landing of a container, and then conduct high-point container landing, automatic dynamic container landing of the container is achieved.

Further, several groups of cameras and corresponding single-point laser devices are cooperated together for high-precision measurement to ensure the accuracy range of the container landing, the accuracy range is usually 3-5 cm, so that the accuracy and efficiency of automatic container loading of the container is improved.

Although the present invention has been disclosed as above in a preferred embodiment, it is not intended to limit the present invention. Any person skilled in the art can make some modifications and improvements without departing from the spirit and scope of the present invention. Therefore, the scope of protection of the present invention should be subject to those defined in the claims.

The invention claimed is:

1. An automatic container landing device based on an expert system, comprising:

at least four groups of cameras and at least six groups of single-point laser devices, the at least four groups of cameras, as well as the first group, the second group, the third group and the fourth group of single-point laser devices in the at least six groups of single-point laser devices are arranged at four spreader corners of a spreader fixing support of the container, the fifth group and the sixth group of single-point laser devices in the at least six groups of single-point laser devices are respectively arranged on outer sides of two short edges of the spreader fixing support;

a front end of the spreader fixing support is lower than a rear end of the spreader fixing support, and the first group of cameras and the second group of cameras in the at least four groups of cameras, as well as the first group of single-point laser devices and the second group of single-point laser devices are arranged at the front end of the spreader fixing support; the third group of cameras and the fourth group of cameras in the at least four groups of cameras, as well as the third group of single-point laser devices and the fourth group of single-point laser devices are arranged at the rear end of the spreader fixing support; the fifth group of single-point laser devices are arranged on outer sides of the short edges of the front end of the spreader fixing support, the fifth group of single-point laser devices are low-point single-point laser devices; the sixth group of single-point laser devices are arranged on outer sides of the short edges of the rear end of the spreader fixing support, the sixth group of single-point laser devices are high-point single-point laser devices; the groups of cameras are cooperated with the corresponding single point laser devices;

if the first group and the second group of single-point laser devices, the low-point and the high-point laser devices have no trigger signal, and there is low-point container landing signal, then low-point container landing is completed and enter high-point container landing; the low-point container landing signal is a corresponding mechanical limit signal generated by an operation container when a bottom of the rear end of the spreader fixing support is in complete contact with a top of a bottom layer of containers;

if the third group and the fourth group of single-point laser devices have no trigger signal, and there is high-point container landing signal or rope loosening signal, high-point container landing is completed, the container landing of the operation container is completed; the high-point container landing signal is a corresponding mechanical limit signal generated by the operation container when the bottom of the rear end of the spreader fixing support is in complete contact with the top of the bottom layer of containers.

2. The automatic container landing device based on an expert system according to claim 1, further comprising a first inertial measurement unit, a second inertial measurement unit, a third inertial measurement unit and a fourth inertial measurement unit arranged at four spreader corners of the spreader fixing support, the first, the second, the third and the fourth inertial measurement units are used to measure and calculate the angle, speed and relative displacement of the spreader.

3. A control method of automatic container landing device based on an expert system, which is applied to the automatic container loading device based on expert system according to claim 2, comprising the following steps:

S11: install at least four groups of cameras and at least six groups of single-point laser devices;

S12: control a spreader to drive an operation container to move to the position above the bottom layer of containers;

S13: control the spreader to drive the operation container to move downwards to trigger dynamic container landing and enter a dynamic container landing mode;

S14: enter low-point container landing, and enter high-point container landing after low-point container landing is completed;

S15: enter high-point container landing to complete container landing of the operation container;

control the spreader to drive the operation container to move downwards to trigger dynamic landing in step S13 comprising when the distance between the bottom of the operation container and the top of the bottom layer of containers is less than or equal to a preset first threshold, the dynamic container landing is triggered;

the step S14 specifically comprising the following steps:

S141: if the first group and the second group of single-point laser devices, as well as the low-point and the high-point single-point laser devices have no trigger signal, the horizontal moving speed calculated by the first and second inertial measurement units is less than a preset first speed threshold value, and there is no low-point container landing signal, control the spreader to descend;

S142: if at least one of the first group and the second group of single-point laser devices, as well as the low-point and the high-point single-point laser devices have a trigger signal, and there is a low-point container landing signal, and it is confirmed that a low-point container landing error is greater than an installation offset distance of the laser devices through the first group and the second group of cameras, then control the spreader to lift a first distance, and conduct low-point container landing again;

S143: if at least one of the first group and the second group of single-point laser devices, as well as the low-point and the high-point single-point laser devices have a trigger signal, and there is no low-point container landing signal, then stop the spreader to descend and obtain a trigger duration of the trigger signal, if the first group of single-point laser devices or the second groups of single-point laser devices are continuously triggered longer than a second threshold, then control the spreader to move a second distance along a width direction of the operation container to the first groups of single-point laser devices or the second groups of single-point laser devices with the trigger signal; if the low-point single-point laser devices or the high-point single-point laser devices are continuously triggered for more than the second threshold, control the spreader to move a third distance along a length direction of the operation container to the low-point single-point laser devices or the high-point single-point laser devices with the trigger signal;

S144: if the first group and the second group of single-point laser devices, as well as the low-point and the high-point single-point laser devices have no trigger signal and there is a low-point container landing signal, low-point container landing is completed and enter high point container landing.

4. A control method of automatic container landing device based on an expert system, which is applied to the automatic container loading device based on expert system according to claim 2, comprising the following steps:

S11: install at least four groups of cameras and at least six groups of single-point laser devices;

S12: control a spreader to drive an operation container to move to the position above a bottom layer of containers;

S13: control the spreader to drive the operation container to move downwards to trigger dynamic container landing and enter a dynamic container landing mode;

S14: enter low-point container landing, and enter high-point container landing after low-point container landing is completed;

S15: enter high-point container landing to complete container landing of the operation container;

control the spreader to drive the operation container to move downwards to trigger dynamic container landing in step S13 comprising when the distance between a bottom of the operation container and the top of the bottom layer of containers is less than or equal to a preset first threshold, trigger the dynamic container landing;

the step S15 specifically comprising the following steps:

S151: if the third group and the fourth group of single-point laser devices have no trigger signal, the horizontal moving speed calculated by the third and fourth inertial measurement units is less than a preset second speed threshold, and there is no high-point container landing signal, control the spreader to descend until obtain the high-point container landing signal;

S152: if the third group and the fourth group of single-point laser devices have a trigger signal, and there is no high-point container landing signal or rope loosening signal, stop the spreader to descend, get an alignment deviation through the third group and the fourth group of cameras, and control the spreader to move the corresponding distance along a width direction of the operation container to the third group and the fourth group of single-point laser devices with a trigger signal;

S153: if the third group and the fourth group of single-point laser devices have trigger signals, and there is a high-point container landing signal or rope loosening signal, and it is confirmed that a high point container landing error is greater than a preset container landing accuracy Dt through the third group and the fourth group of cameras, then control the spreader to lift for a fourth distance, and conduct high-point container landing again;

S154: if the third group and the fourth group of single-point laser devices have no trigger signal, and there is high-point container landing signal or rope loosening signal, high-point container landing is completed, complete the container landing of the operation container.

5. The control method of automatic container landing device based on an expert according to claim 3, wherein the second threshold is T/2, T is the swing period of the spreader, and the swing period T is determined by the formula $T=\alpha*2\pi\sqrt{l/g}$, where l is the rope length of the spreader, $\alpha$ is the damping coefficient.

6. The automatic container landing device based on an expert system according to claim 1, wherein the first, the second, the third, the fourth, the fifth and the sixth groups of single-point laser devices are used to measure a height difference between a laser emission point and a laser reflection point to confirm a landing error of the operation container;

the first, the second, the third and the fourth groups of cameras obtain the distance between a light spot of the corresponding single-point laser device and a side of the bottom container through images, or the first, the second, the third and the fourth groups of cameras obtain the distance between a side of the operation container and a side of the bottom container through the images to confirm the landing error of the operation container.

7. The automatic container landing device based on an expert system according to claim 1, wherein, a distance between light spots of the first, the second, the third, the fourth, the fifth and the sixth groups of single-point laser devices and a side of the operation container is measured through the first, the second, the third, the fourth groups of cameras, the position and angle of the first, the second, the third, the fourth, the fifth and the sixth groups of single-point laser devices is adjusted, so as to calibrate the position and angle of the first, the second, the third, the fourth, the fifth and the sixth groups of single-point laser devices, so that the distance between light spots of the first, the second, the third, the fourth, the fifth and the sixth groups of single-point laser devices and the side of the operation container is a preset installation offset distance of the laser devices.

8. A control method of automatic container landing device based on an expert system, which is applied to the automatic container loading device based on expert system according to claim 1, comprising the following steps:

S11: install at least four groups of cameras and at least six groups of single-point laser devices;

S12: control a spreader to drive an operation container to move to the position above the bottom layer of containers;

S13: control the spreader to drive the operation container to move downwards to trigger dynamic container landing and enter a dynamic container landing mode;

S14: enter low-point container landing, and enter high-point container landing after low-point container landing is completed;

S15: enter high-point container landing to complete container landing of the operation container.

9. The control method of automatic container landing device based on an expert according to claim 8, wherein the controlling of the spreader to drive the operation container to move downwards to trigger dynamic container landing in step S13 comprises, when the distance between a bottom of the operation container and the top of the bottom layer of containers is less than or equal to a preset first threshold, the dynamic container landing is triggered.

10. The control method of automatic container landing device based on an expert system according to claim 9, wherein, the step S11 further comprises that the at least four groups of cameras and the at least six groups of single-point laser devices are calibrated, a distance is measured between light spots of the first group, the second group, the third group, the fourth group, the fifth group and the sixth group of single-point laser devices, as well as the low-point and the high-point single-point laser devices and a side of a box through the first group, the second group, the third group, the fourth group of cameras, and the position and angle of the first group, the second group, the third group, the fourth group, the fifth group and the sixth group of single-point laser devices, as well as the low-point and the high-point single-point laser devices to calibrate the position and angle of the first group, the second group, the third group, the fourth group, the fifth group and the sixth group of single-point laser devices, as well as the low-point and the high-point single-point laser devices, so that the distance between the light spots of the first group, the second group, the third group, the fourth group, the fifth group and the sixth group of single-point devices, as well as the low-point and the high-point single-point laser devices and a side of the operation container is a preset installation offset distance of the laser devices.

* * * * *